US011731815B2

(12) United States Patent
Sullivan et al.

(10) Patent No.: US 11,731,815 B2
(45) **Date of Patent: *Aug. 22, 2023**

(54) PACKAGING WITH SEPARABLE LINER AND LIDDING

(71) Applicant: CDF CORPORATION, Plymouth, MA (US)

(72) Inventors: Joseph Sullivan, Plymouth, MA (US); Maxwell Sullivan, Plymouth, MA (US)

(73) Assignee: CDF Corporation, Plymouth, MA (US)

( * ) Notice: Subject to any disclaimer, the term of this patent is extended or adjusted under 35 U.S.C. 154(b) by 36 days.

This patent is subject to a terminal disclaimer.

(21) Appl. No.: 17/386,367

(22) Filed: Jul. 27, 2021

(65) Prior Publication Data

US 2021/0394980 A1 Dec. 23, 2021

Related U.S. Application Data

(63) Continuation of application No. 15/804,678, filed on Nov. 6, 2017, now Pat. No. 11,077,996.
(Continued)

(51) Int. Cl.
*B65D 51/20* (2006.01)
*B65D 75/58* (2006.01)
(Continued)

(52) U.S. Cl.
CPC ..... *B65D 51/20* (2013.01); *B65D 25/14* (2013.01); *B65D 43/02* (2013.01);
(Continued)

(58) Field of Classification Search
CPC .. B32B 2307/748; B65D 51/20; B65D 25/14; B65D 43/02; B65D 65/40;
(Continued)

(56) References Cited

U.S. PATENT DOCUMENTS 2,719,663 A 10/1955 Gunther
3,131,069 A 4/1964 Goller et al.
(Continued)

OTHER PUBLICATIONS

PCT International Search Report and Written Opinion, Application No. PCT/US2017/060223, dated Jan. 17, 2018, 11 pages.
(Continued)

*Primary Examiner* — Gideon R Weinerth
(74) *Attorney, Agent, or Firm* — Dorsey & Whitney LLP

(57) ABSTRACT

A packaging assembly for holding contents is provided. The packaging assembly includes a self-supporting liner having a wall that encloses sides and bottom of an interior of the liner and defines an open top end of the liner, and a rim that projects outwardly from the wall proximal to the open top end. The packaging assembly also includes a lidding assembly including a cover region and a destructible seal region that seals the cover region to the liner extending over and closing the liner open top. The destructible cover region is weaker than the liner and the cover region so that detachment of the cover region from the liner causes the destructible seal region to fail. The lidding assembly includes a first lidding material having a center portion and an outer portion that surrounds the center portion.

20 Claims, 5 Drawing Sheets

Related U.S. Application Data

(60) Provisional application No. 62/496,998, filed on Nov. 5, 2016.

(51) Int. Cl.
*B65D 75/62* (2006.01)
*B65D 77/20* (2006.01)
*B65D 25/14* (2006.01)
*B65D 43/02* (2006.01)

(52) U.S. Cl.
CPC .... *B65D 77/2024* (2013.01); *B65D 2251/009* (2013.01); *B65D 2251/0018* (2013.01); *B65D 2251/0028* (2013.01); *B65D 2251/0093* (2013.01); *B65D 2577/2091* (2013.01)

(58) Field of Classification Search
CPC ..... B65D 75/5838; B65D 75/002; B65D 75/5855; B65D 77/2024; B65D 77/206; B65D 77/2032; B65D 2251/0018; B65D 2251/0028; B65D 2251/009; B65D 2251/0093; B65D 2577/2091; B65D 2543/00527; B65D 2543/00203; B65D 2543/00537; B65D 2543/00296; B65D 2543/0062; B65D 2543/0074; B65D 2543/00268; B65D 2543/00435
USPC ..... 220/23.87
See application file for complete search history.

(56) References Cited

U.S. PATENT DOCUMENTS 3,151,800 A 10/1964 Griese
3,194,479 A * 7/1965 Rumberger ..... B29C 66/131 229/160
3,202,271 A 8/1965 Douglas
3,298,505 A 1/1967 Stephenson
3,366,309 A * 1/1968 Scharre ..... B65D 77/2008 426/123
3,391,852 A 7/1968 Waldrop
3,410,697 A 11/1968 Stephenson
3,464,832 A * 9/1969 Mullinix ..... B65D 77/2032 229/125.05
4,022,324 A * 5/1977 Schuster ..... B65D 81/28 206/439
4,055,672 A 10/1977 Hirsch et al.
4,340,138 A 7/1982 Bernhardt
4,382,513 A 5/1983 Schirmer et al.
4,433,808 A 2/1984 Gordon et al.
4,469,258 A 9/1984 Wright et al.
4,531,668 A 7/1985 Forbes
4,691,372 A 9/1987 Van
4,905,838 A 3/1990 Suzuki et al.
4,915,289 A 4/1990 Hatano et al.
5,281,453 A 1/1994 Yamada et al.
5,341,952 A * 8/1994 Goglio ..... B65D 77/06 229/125.09
5,388,757 A 2/1995 Lorenzen
5,686,126 A 11/1997 Noel et al.
6,234,386 B1 5/2001 Drumond et al.
6,355,286 B2 3/2002 Deering et al.
6,364,113 B1 * 4/2002 Faasse, Jr. ..... G09F 3/0341 206/459.1
6,892,933 B2 5/2005 Sullivan, Jr.
7,216,764 B2 * 5/2007 Forman ..... B65B 61/184 206/532
7,276,269 B2 10/2007 Kraimer et al.
7,740,730 B2 6/2010 Schedl et al.
8,308,021 B2 * 11/2012 Turvey ..... B65D 43/0218 220/780
8,354,132 B2 1/2013 Stephens et al.
8,541,081 B1 9/2013 Ranganathan et al.
8,567,660 B2 * 10/2013 Sullivan ..... B65D 5/60 229/125.05
8,746,490 B2 6/2014 Huffer et al.
9,150,342 B2 10/2015 Sierra-Gomez et al.
9,469,088 B2 10/2016 Stanley et al.
9,802,744 B2 10/2017 Huffer
9,809,368 B2 * 11/2017 Hutter ..... B29C 65/02
10,717,581 B2 * 7/2020 Sullivan, Jr. ..... B65D 77/2032
10,865,023 B2 * 12/2020 Huffer ..... B65D 25/54
11,383,908 B2 * 7/2022 Caleman ..... B32B 7/06
2002/0125253 A1 * 9/2002 Massey ..... B29C 66/8491 220/359.4
2004/0013827 A1 1/2004 Zuser et al.
2005/0017005 A1 1/2005 Nomula
2006/0032775 A1 2/2006 Forman et al.
2010/0019022 A1 1/2010 Ryan et al.
2011/0114714 A1 * 5/2011 Sullivan ..... B65D 5/5425 229/117.3
2013/0206763 A1 8/2013 Sinn et al.
2015/0083717 A1 3/2015 Sullivan et al.
2016/0096667 A1 4/2016 Huffer
2016/0122109 A1 * 5/2016 Clark ..... B65D 75/5888 220/23.4
2017/0057728 A1 * 3/2017 Shaw ..... B65D 77/2096
2017/0096276 A1 * 4/2017 Zanarella ..... B29C 65/02
2017/0240331 A1 * 8/2017 Huffer ..... B65D 75/327
2018/0327158 A1 * 11/2018 Makowski ..... B65D 77/206
2019/0112109 A1 4/2019 Huffer
2019/0270547 A1 9/2019 Thorstensen-Woll
2021/0394980 A1 * 12/2021 Sullivan ..... B65D 25/14
2022/0267079 A1 * 8/2022 Van Vynckt ..... B65D 81/3453

OTHER PUBLICATIONS

AZOM, Polyethylene Terephthatlate Polyester (PET, PETP)—Properties and Applications—Supplier Data by Goodfellow, AZO Materials, Jun. 25, 2003.

* cited by examiner

PACKAGING WITH SEPARABLE LINER AND LIDDING

CROSS REFERENCE TO RELATED APPLICATION

This application is a continuation of U.S. application Ser. No. 15/804,678, filed 6 Nov. 2017, entitled "PACKAGING WITH SEPARABLE LINER AND LIDDING", which claims priority to U.S. Provisional Patent Application No. 62/496,998, entitled "PACKAGING WITH SEPARABLE LINER AND LIDDING" and filed on 5 Nov. 2016, each of which are herein incorporated by reference in their entirety.

TECHNICAL FIELD

The present disclosure relates to packaging and, more particularly, to a sustainable packaging system including a sealed liner assembly for shipping liquid, viscous, or particulate products, the liner being separable from the lidding for recycling of each portion separately.

BACKGROUND

In the shipping industry, numerous types of containers are used from heavy-duty thick-walled plastic or metal buckets down to bag-in-box type containers. Universally used containers need to be recycled. In the food industry, reuse of containers is frequently not feasible, creating limitations for certain containers. Limitations stem from plastic recycling requirements and food packaging regulations. Environmental regulations require containers with a volume of 5 gallons or less to be made of a recyclable material. Additionally, governmental regulations require that plastic containers for foodstuffs be made of a virgin plastic material. Recycling difficulties arise with previous self-supporting plastic containers in that their covers are not separable from the self-supporting plastic containers in such a way as to allow for recycling. As such, both the container and the attached cover are not recyclable, at least not without expense post-processing.

SUMMARY

In accordance with various embodiments, packaging assembly for holding contents includes a self-supporting liner. The self-supporting liner includes a wall that encloses sides and bottom of an interior of the liner and defines an open top end of the liner, and a rim that projects outwardly from the wall proximal to the open top end and a return from the rim forming a skirt extending downwardly from the rim. The packaging assembly for holding contents also includes a lidding assembly including a cover region and a destructible seal region that seals the cover region to the liner extending over and closing the open top end liner. The destructible seal region may be weaker than the liner and the cover region so that detachment of the cover region from the liner causes the destructible seal region to fail. The lidding assembly includes a first lidding material having a center portion and an outer portion that surrounds the center portion. The center portion is movable with respect to the outer portion to open an opening through the first lidding material while remaining at least partially attached to the outer portion. The packaging assembly for holding contents also includes a closing feature configured to close and secure the center portion after opening.

In accordance with various embodiments, the closing feature is a second lidding material overlapping and connected to the center portion and outer portion, the second lidding material being connected to the outer portion by a resealable adhesive to seal the liner interior. The destructible seal region is disposed on the outer portion. The destructible seal region is located proximal to the perimeter of the self-supporting liner wherein the lidding assembly and the self-supporting liner seal to one another. The second lidding material includes a peel-reseal seal configured to seal the second lidding and unseal the second lidding a plurality of times. The connection between the lidding assembly and the self-supporting liner at the destructible seal region is about 2-10 times stronger than the peel-reseal seal, such that the destructible seal region remains intact while the peel-reseal seal is unsealed and resealed a plurality of times.

In accordance with various embodiments, a destructible seal region release force may be less than a maximum force an average user can apply to the lidding assembly by hand such that the average user can remove the lidding assembly from the self-supporting liner by hand. A destructible seal release force may be greater than a force applied by contents of the self-supporting liner when inverted. The destructible seal region is a sealing layer formed of a first polymer and a second polymer, wherein the first polymer forms a stronger heat seal than the second polymer. The first polymer is ethylene-vinyl acetate (EVA) and the second polymer is a modified rubber. The first lidding material includes a plurality of plies including an oxygen barrier ply laminated with a polymer ply. A first seal release force may be greater than a force required to at least partially delaminate the polymer ply from the oxygen barrier ply. The delamination is limited to the destructible seal region. The destructible seal region includes the region of the lidding material extending from an inside edge of a flange of the self-supporting liner to the outside edge of the lidding material. The separation of the lidding material from the self-supporting liner causes delamination of one or more plies of the first lidding material. The separation of the lidding material from the self-supporting liner occurs at the first seal with substantially no destruction of the lidding assembly or the self-supporting liner. The first seal is a heat seal between the lidding assembly and the self-supporting liner. The first seal includes an adhesive between the first layer and the self-supporting liner.

In accordance with various embodiments, the self-supporting liner is made of recyclable high-density polyethylene. The first lidding material is affixed directly to the flange of the self-supporting liner. The second lidding material is separable from the first lidding material with less force from a user than the force required for the lidding assembly to be separated from the self-supporting liner along the first destructible seal region such that the second lidding material is openable and closable without effecting the seal at the sealing region. The rim surrounds the open top end. The lidding assembly is attached to the rim. The wall of the liner includes a plurality of side walls and a bottom wall that are formed integrally with each other to enclose and seal sides and bottom of the liner interior. The plurality of side walls extend upwardly from the bottom wall. The second lidding material extends less than the entire center portion. The first lidding material extends less than the entire area of the rim.

In accordance with various embodiments, the packaging assembly for holding contents includes a self-supporting liner for holding contents therein and having a plurality of side walls, a closed bottom end characterized by a bottom wall formed integral with the side wall, and an open top end having an outwardly-projecting rim. The packaging assembly for holding contents also includes a lidding assembly connected to the self-supporting liner along a destructible seal region via a destructible first seal having a first release force. The lidding assembly is connected to the self-supporting liner at the open top end of the self-supporting liner operably sealing the contents therein. Lidding assembly includes a first lidding material having a center portion and a remaining portion. The center portion is movable to form an opening through the first lidding material and at least partially detached from the remaining portion along at least one edge of the center portion. The lidding assembly also includes a second lidding material connected to the first lidding material along a second sealing region via a destructible second seal having a second release force. The second seal is an adhesive that overlaps with the remaining portion such that the second lidding material is attached to the center portion and the remaining portion, wherein the second lidding material is resealable to seal the contents in the self-supporting liner. The first release force is sufficiently small for an average user to detach the first lidding material from the self-supporting liner by hand and the second release force is less than the first release force.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1:
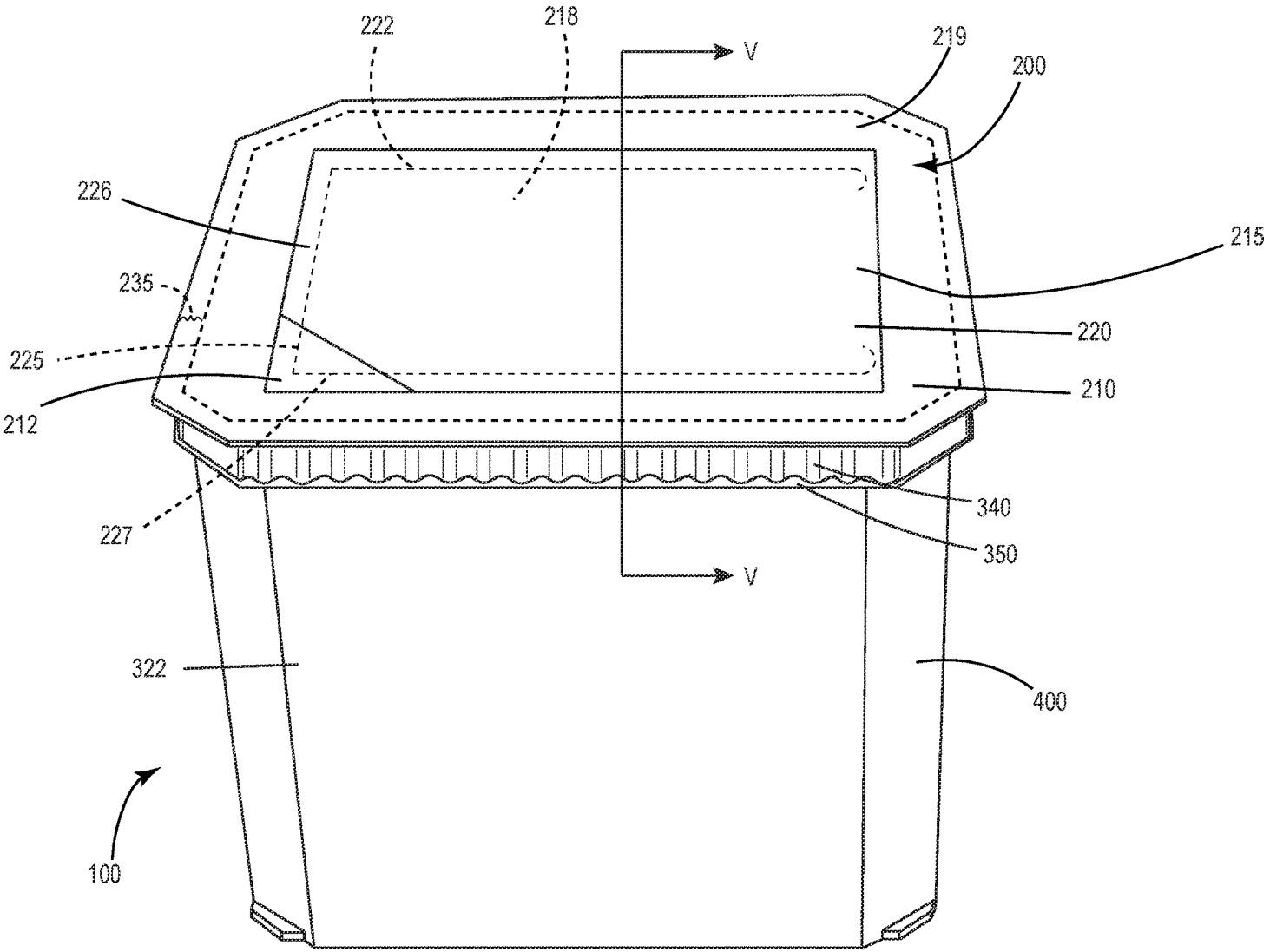
FIG. 1 is a side perspective view of a packaging system in accordance with various embodiments as provided herein.
Figure 2:
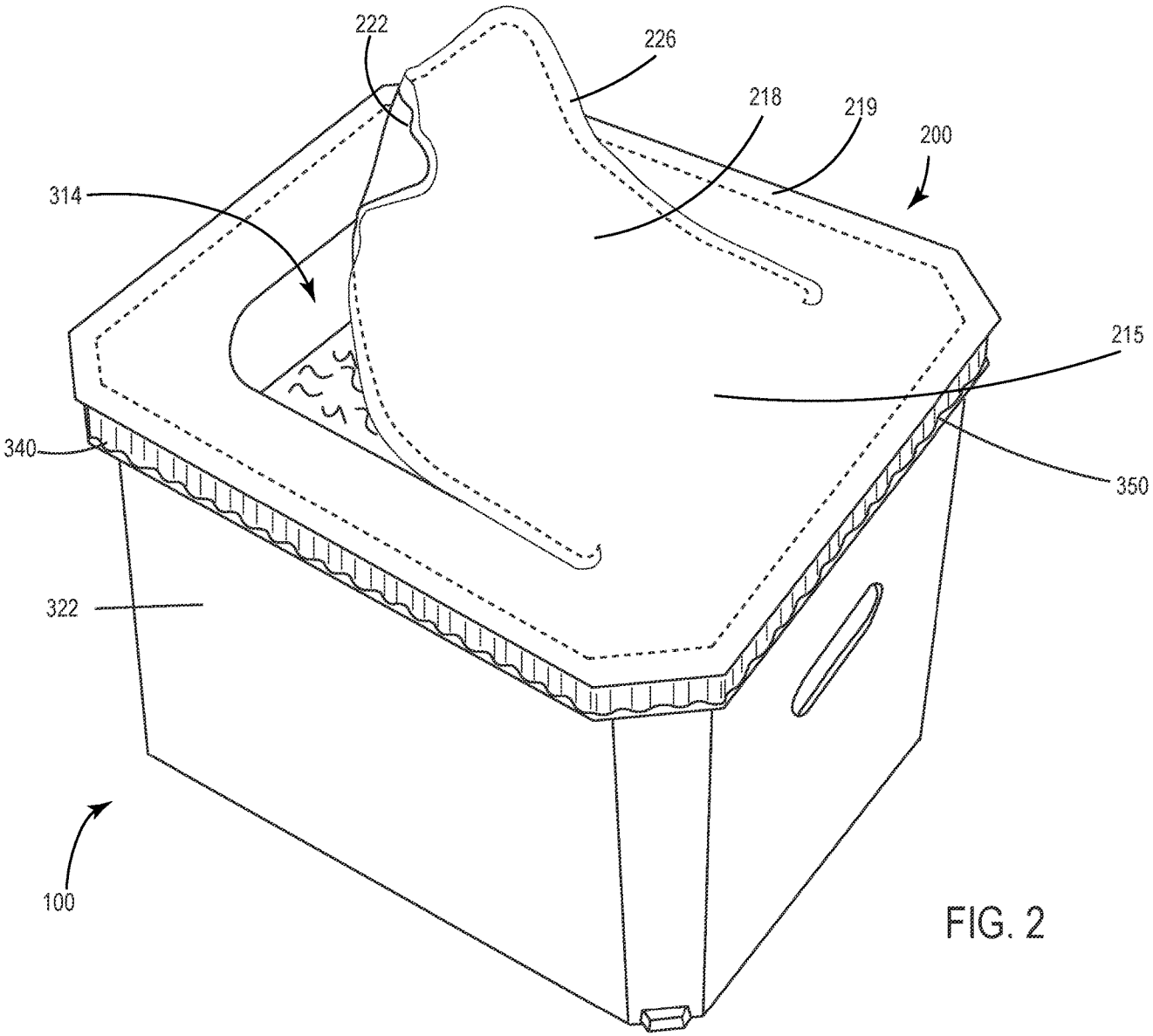
FIG. 2 is a side and rear perspective view of a partially opened packaging system of FIG. 1 in accordance with various embodiments as provided herein.

The present disclosure relates to a novel and advantageous sustainable packaging system that may be used to ship liquid or viscous products or particulate matter. The packaging system of the present disclosure generally includes an outer container or carton box and an inner liner. The inner liner may be sealed after the liner is filled with product. A liner cover may be placed over the sealed liner and/or a carton box cover may be placed over the cardboard box containing the sealed and filled inner liner. The liner may be sealed by applying a lidding material over top of the liner. This lidding material can include two different seals. The lidding material may be separable from the liner, allowing each of the liner and the lidding material to be recycled separately.

In accordance with various embodiments, as illustrated by example in FIGS. 1-4, a packaging system 100 includes a lidding assembly 200 and a liner 300. In various embodiments, the packaging system 100 can also include a carton 400 and/or a lid 500 (as shown e.g. in FIG. 4). The lidding assembly 200 may be sealed to the liner 300 along a destructible seal region 235. In embodiments having the carton 400, the carton 400 receives the liner 300 therein. In embodiments having the lid 500 as illustrated for example in FIG. 4, the lid 500 covers the liner 300 received within the carton 400 forming a closure around the entire system.

The lidding assembly 200 may be sealed over the top of the liner 300 in order to contain the product within the liner 300. The lidding assembly 200 can be advantageous when the contents of the liner must be protected against moisture, air, bacteria, or other materials that may have a deleterious effect on the contents. The lidding assembly 200 may be, for example, a thin film plastic material or a thin metal foil that may be sealed to the liner 300 by any means, for example by hermetically heat-sealing the lidding assembly 200 to the liner 300. In other embodiments, the lidding material may be manufactured from any material suitable for sealing the liner from one or more of moisture, air, bacteria, or other materials that may have a deleterious effect on the contents. In some embodiments, the lidding material may be made of a 100% recyclable material. In accordance with a preferred embodiment, the lidding assembly 200 includes a protective layer 210. For example, the layer can be made of a metallized material or structure, such as polyethylene terephthalate, mono-oriented polypropylene film, or COEX NYL/PE or a combination thereof that acts as an oxygen and moisture barrier. In a preferred example, layer 210 may be a metallized oriented polypropylene (MOPP) layer. Metallized films are polymer films coated with a thin layer of metal, usually aluminum. They offer the glossy metallic appearance of an aluminum foil at a reduced weight and cost. Metallized films are widely used for decorative purposes and food packaging. Metallization is performed using a physical vapor deposition process. Aluminum may be a typical metal used for deposition, but other metals such as nickel or chromium are also used. The metal is heated and evaporated under vacuum. This condenses on the cold polymer film, which is unwound near the metal vapor source. This coating is much thinner than a metal foil (although a metal foil may also be used in various embodiments) could be made, in accordance with various embodiments in the range of 40 ga to 100 ga. For example, the first layer may be about 70 ga MOPP. In various embodiments, either polypropylene, nylon, polyethylene, cast polypropylene and polyethylene terephthalate (PET) may be used with metallization. The metallized structure also includes sufficient hot tack and seal strength such that the packaging system 100 is suitable for packaging both hot and cold materials. The protective layer 210 can also be made of an opaque material to reduce the amount of light that enters the interior of the liner 300. In some embodiments, the protective layer 210 can be made of material that reflects or reduces ultraviolet light exposure. In various embodiments, the protective layer 210 includes multiple plies of material as shown in FIG. 5C. For example, the one ply is an oxygen or moisture barrier 214 such as a metalized layer. This layer may be laminated with one or more polymer layers such as layer 216 and or layer 214.

As indicated above, in accordance with various embodiments, the lidding assembly 200 and the liner 300 are attached via a seal 230. In one example, the seal 230 is located within the destructible seal region 235. This seal is a connection mechanism configured to hold the lidding assembly 200 and the liner 300 together until a user asserts an opposing force between the two components sufficient to separate them. The destructible seal region 235 is the region in which these two components separate. In some embodiments, the separation is insignificantly destructive. Insignificantly destructive is quantified in that an insignificant portion of the lidding assembly 200 remains on the liner 300 still attached via the seal 230. An insignificant portion of lidding assembly 200 can be defined as a portion that would allow the liner 300 to still be recycled without additional processing to remove the portions of the lidding assembly 200 such that the recycling process of the liner 300 is not significantly affected by the remaining lidding material. An example of an insignificantly destructive separation is one in which some portion of the lidding assembly 200 delaminates upon separation leaving the delaminated portion of the lidding assembly 200 attached to the liner 300.

Figure 5A:
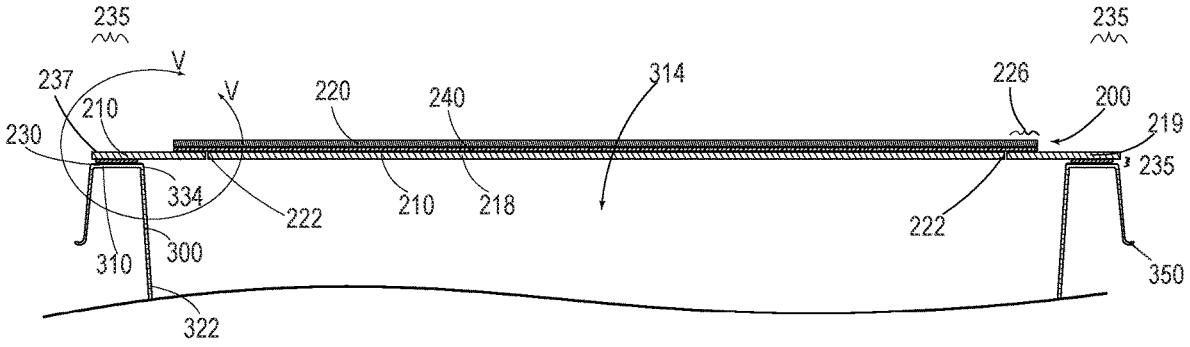
FIG. 5A is a cross-section view of a packaging system taken along cross-section line V-V shown in FIG. 1 in accordance with various embodiments as provided herein.
Figure 5B:
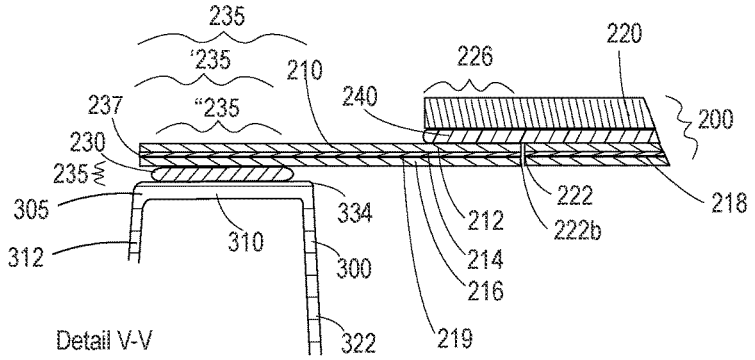
FIGS. 5B-C are detailed views V-V shown in the cross-section of 5A in accordance with various embodiments as provided herein.
Figure 5C:
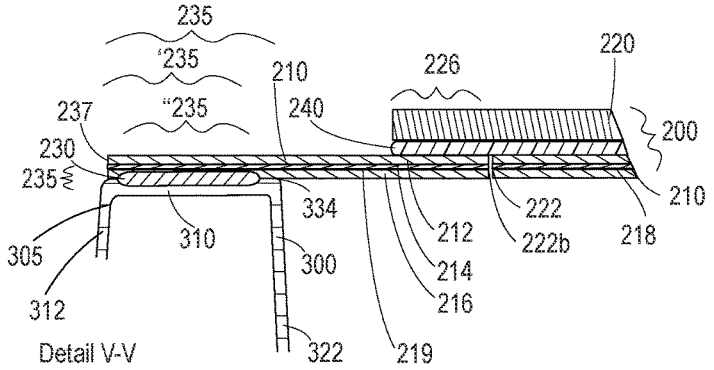

In one example, a seal 230 that connects the lidding assembly 200 and the liner 300 as shown in FIGS. 5A-5C is a heat seal. In such an example, the heat seal 230 bonds at least a portion of the lidding assembly 200 (e.g. one or more of the layers 216, 214, and/or 212) to the liner 300. In one example, as shown in FIG. 5C, the heat seal bond extends between and bonds a ply 216 of layer 210 to the flange 310. In other embodiments, multiple plies may be bonded to flange 310 or, in some cases, the entire layer 210 may be bonded to flange 310. In yet another embodiment, all of layer 210 and layer 220 may be bonded to the flange 310.

In other embodiments, the separation is clean, in that the lidding assembly 200 fully separates from the liner 300 by detaching the seal 230 such that only portions of the seal remain on either the lidding assembly 200 or the liner 300. Such a seal is referred to herein as a destructible seal. Therefore, in various examples the seal between liner 300 and lidding assembly 200 is destructible seal 230. The destructible seal is destructible because the seal itself fails, is broken, is severed, or is otherwise destructible in light of sufficient force applied to the components. In this way, the components themselves do not fail but the sealing mechanism between them fails. An example of such a seal could be an adhesive positioned between the components. In such an example, the force required to detach the adhesive (i.e. release force) is less than the force required to destroy any portion of the lidding assembly (i.e. tear a layer or ply or delaminate the same).

In accordance with various embodiments, the connection between the lidding assembly 200 and the liner 300 can include a destructible seal region 235. The lidding assembly can also include a cover region, which is the region of the lidding assembly not destroyed by separating the lidding assembly from the liner. In preferred embodiments, the destructible seal region 235 extends significantly less than the width of the lidding assembly 200 and less than the thickness of the lidding assembly 200. As shown in FIG. 5A-C, the destructible seal region 235 may extend around only a portion of the edges of the lidding assembly 200 and less than half the thickness of the layer 210. In various embodiments, the separation of the lidding assembly 200 and the liner 300, whether destructive or clean (as discussed above), occurs within the destructible seal region 235. In destructive separation, the destructible seal region 235 may include the region that undergoes the insignificant destruction (e.g. the region in which the lidding assembly 200 undergoes delamination). As shown in FIG. 5C, the seal 230 may form part of one ply (e.g. a heat seal that binds ply 216 into flange 310) or form a bond stronger than one ply. In such examples, the destruction of the seal is likely to include the destruction of the ply as well, causing delamination and tearing some portion of the ply. In one example, this region 235 includes the region between the interior edge 334 of the liner flange 310 and the exterior edge 237 of the delaminating ply of the lidding assembly (e.g. ply 216). In another example, this region '235 includes the region including the seal 230 out to the exterior edge 137 of the delaminating ply of the lidding assembly (e.g. ply 216). In another example, this region "235 includes the regions of the delaminating ply of the lidding assembly (e.g. ply 216) in immediate proximity to the seal but not including the regions out to the edges of the flange 310 and the edge 237.

In accordance with embodiments configured with a clean separation, the destructible seal region 235 may include only the seal 230, as the destruction of any component is limited to the seal itself. In any of the various embodiments, the destructible seal 230 can extend over substantially all of the sealing region 235. In other embodiments, however, the destructible seal 230 extends over less than the entire sealing region 235.

In accordance with various embodiments, the separation of the lidding assembly 200 and the liner 300 is performed by a user by hand, meaning that the connection between the lidding assembly 200 and the liner 300 is sufficiently weak that an avenger user (as would be understood by a person of ordinary skill in the viscous and granular shipping container art) would be able to use grip strength to grasp the lidding assembly 200 and pull it off of the liner 300. In doing this, the lidding assembly 200 and the liner 300 are separated either destructively or cleanly as provided herein. As such, under sufficient force the release force of the sealing region 235 is overcome by the user by hand to separate the components.

In some embodiments, the lidding assembly does not necessarily delaminate but, instead, the destructive layer 230 fails. For example, the destructible seal 230 can be a sealant layer that fails under force from the user. In various embodiments, such a sealant layer can use a combination of different polymers, where each of the polymers reacts differently to the heat sealing process that seals the lidding assembly 200 to the liner 300. For example, one polymer may heat seal to the liner better (i.e., form a stronger bond) than the other. In accordance with one embodiment, the sealant layer can include ethylene-vinyl acetate (EVA) and a modified rubber. In such a configuration the EVA heats seals to the rim of the liner 300 better than the modified rubber. So, in response to the separation of the lidding assembly 200 from the liner 300, the EVA and the modified rubber combination separates. In some instances, both polymers may separate from the liner, but typically a residue (of both polymers) may remain on the rim of the liner where the two polymers formed the destructible seal 230.

In one embodiment, a portion of the lidding material may include ink on a polyester layer that is connected to an ethylene vinyl alcohol (EVOH) layer via a tie layer. The EVOH layer may then be connected to the destructible sealant layer 230 via another tie layer.

As can be seen in FIGS. 5A-5C, the lidding assembly 200 may cover the entire open area 314 of the liner 300 and may be sealed to the radially extending flange 310 which runs along the perimeter of the sidewall 322 of the liner 300. In this way, the seal 230 is a perimeter seal securing lidding assembly 200 to the flange 110. In accordance with a preferred embodiment, the lidding assembly 200 also includes a resealable layer 220. The layer 220 is provided for repeatable access into the liner 300. The lidding assembly 200 includes edges 237 defined by outer edges of at least one of the first layer 210 or the second layer 220. The first layer 210 and the second layer 220 can be approximately the same size and adhered to each other or the second layer 220 can be smaller than the first layer 210. In the preferred embodiment, the second layer 220 is permanently affixed to the first layer 210 and the first layer 210 is positioned so that it faces the interior of the liner 300. One of the two layers can function as a stiffing layer that is operable to limit the lidding assembly 200 from folding over on itself under its own weight or small forces. In various embodiments, the second layer may remain attached to at least a portion of the first layer. The resealing layer 220 may detachably connect to one portion of the first layer 210 but remain attached to another portion of the first layer 210.

In accordance with various embodiments, a portion of layer 210 is movable relative to a second portion of layer 210. For example, the layer 210 includes a center portion 218 and an outer portion 219 adjacent the center portion 218. The center portion 218 is positioned at a predetermined distance from the edge 237 of the lidding assembly 200. In various examples, the center portion 218 may be defined by the at least one edge 222. The edge 222 can be a single edge defining, for example, a single slit for access. The edge 222 can be a plurality of edges forming a variety of shapes to create an opening in the first layer 210. In various examples, the center portion 218 may be defined by four edges as illustrated in FIGS. 1-4. In another example, the center portion may be defined by at least three edges. The center portion 218 is detached from the remaining portion 219, forming at least one edge 222 on the center portion 218 and edge 222*b* on the remaining portion 219. This allows the center portion 218 to be movable to expose opening 314 thereunder. In some embodiments, this may expose a tamper layer covering the opening 314 such as those described in incorporated documents.

While most of the examples and embodiments provided herein are directed to those in which the layer 210 provides a closure over the center opening, it is also contemplated herein that layer 210 has no center portion, but instead defines a center opening. In such embodiments, a second layer may cover the opening. The second layer may also include layers similar to the first layer such as the oxygen barrier. In the various embodiments, the lidding assembly 200 may merely include an openable portion regardless of its mechanism. This openable portion may be removed and recycled separately from the liner 300.

The detached edges 222 are preferably perforated or have a pre-torn slit that separates the three edges of the center portion 218 from the outer portion 219 of the first layer 210. The fourth or remaining edge of the center portion 218 is preferably affixed to the outer portion 219 to act as a hinge 215 so that the center portion 218 can be pulled back to expose the opening 314 thereunder. The center portion 218 of the lidding assembly 200 can then be resealed to seal the open area 314 of the liner 300.

The detached edges 222 may be perforated, cut, or have a slit that separates the three edges of the center portion 218 from the outer portion 219 of the first layer 210. The fourth or remaining edge of the center portion 218 is preferably affixed to the outer portion 219 to act as a hinge 215 so that the center portion 218 can be pulled back to expose opening 314. The center portion 218 of the lidding assembly 200 can then be resealed to seal the open area 314 of the liner. As the first layer 210 is opened via the hinge, the second layer 220 remains attached to the center portion 218 while releasing from the remaining edge 218.

The second layer 220 preferably includes a portion 226 that extends beyond the sides of the center portion 218. The portion 226 can include an adhesive on the portion 226. The adhesive portion 226 includes a resealable adhesive 240 on the bottom surface of the adhesive portion 226 facing the interior. As the user pulls back the center portion 218, the adhesive portion 226 is also pulled back with the center portion 218. The adhesive portion 226 preferably includes a resealable adhesive material that can be sealed and resealed multiple times to facilitate resealing the center portion 218 against the lidding assembly 200, for example against the portion of the first layer 210 adjacent the center portion 218 and edge 237.

Figure 3:
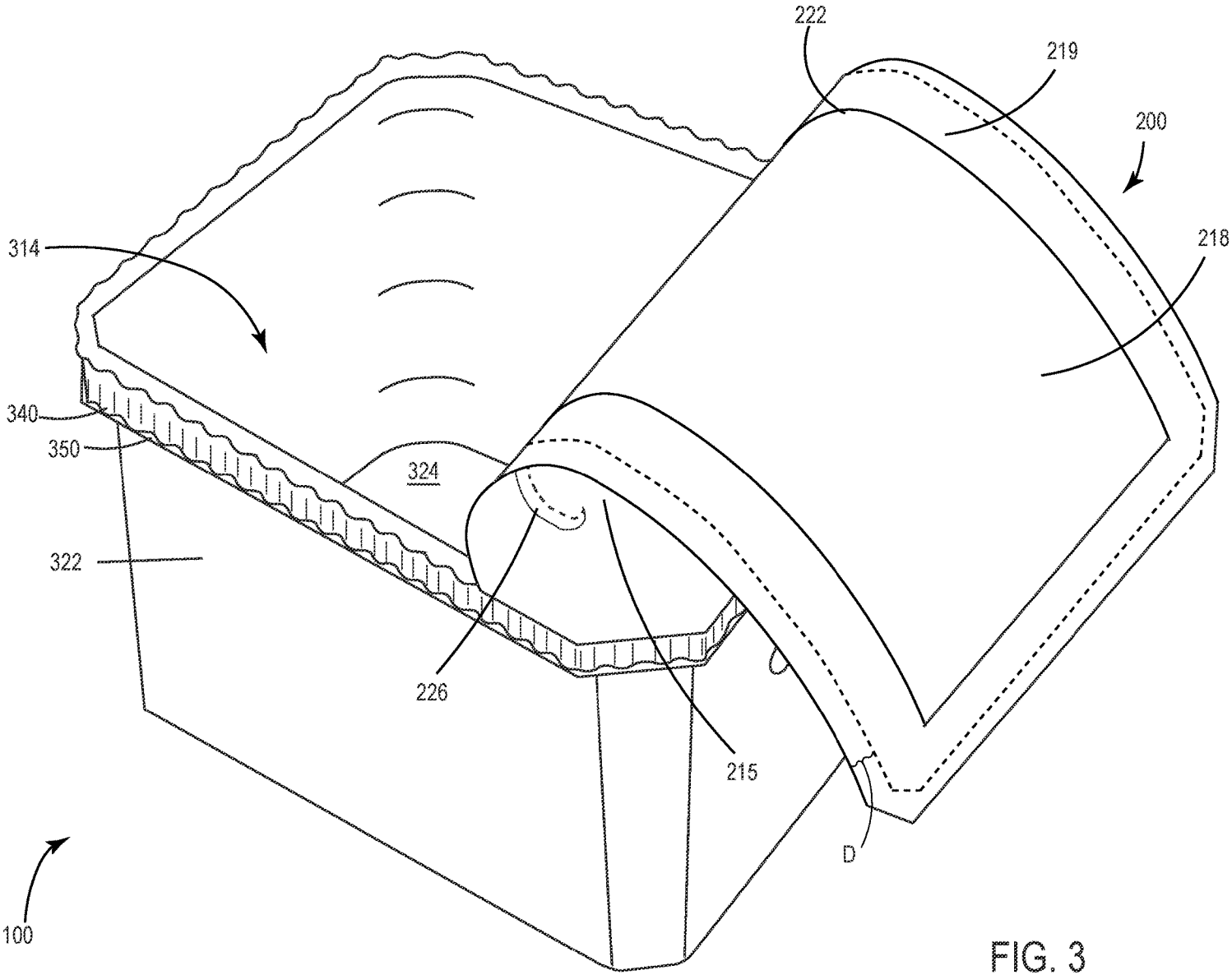
FIG. 3 is a side and rear perspective view of a fully opened packaging system of FIG. 1 in accordance with various embodiments as provided herein.

The reseal is possible because an adhesive portion 226 overlaps the detached edges 222 from the center portion 218 to the outer portion 219 such that when the adhesive portion 226 is attached to the outer portion 219 it is also attached to the center portion 218, thereby sealing the lidding assembly 200. Adhesive portion 226 may be a distance of D wide as illustrated in FIG. 3. D may typically be greater than ⅛ of an inch. In various examples, D may be from ¼ to ½ inch wide. The adhesive portion 226 includes a resealable adhesive 240 on the bottom surface of the adhesive portion 226 facing the opening 314. As the user pulls back the center portion 218, the adhesive portion 226 is also pulled back with the center portion 218. The adhesive portion 226 preferably includes a resealable adhesive material that can seal and reseal multiple times to facilitate resealing the center portion 218 against the lidding assembly 200, for example against the portion of the first layer 210 adjacent the center portion 218 and edge 222.

In various embodiments, the lidding assembly 200 includes a tab 212. In some configurations, the tab can be a portion of either the first layer 210 or second layer 220. In yet other configurations, no tab is provided. As indicated above, the lidding assembly 200 includes a tab 212. The tab 212 may have similar adhesion to the rest of second layer 220 or the tab 212 may have lower adhesion as compared to the rest of the second layer 220. The tab 212 may be free of adhesive, allowing a user to easily grasp the tab 212 and pull back the center area 218 of the lidding assembly 200. This may allow the user to easily grasp the tab 212 and pull back the center area 218 of the lidding assembly 200. In some configurations, the tab can be a portion of either the first layer 210 or second layer 220. In yet other configurations, no tab is provided. In one example, the center portion 218's detached edge 222 includes a first edge 225 and a second edge 227. The lidding assembly 200 includes a corner tab 212 that is defined by an area where the first edge 225 and the second edge 227 meet at a corner. The tab is operable to extend away from the surface of lidding assembly 200 such that it can be gripped and pulled. Tab 212 may be movable such that it can be operatively pulled away from the layer 210. This force from tab 212 allows for separation between the portion of second layer 220 and first layer 210 which is attached along the remaining portion 219. This attachment may be adjacent the first edge 225 and the second edge 227. Thus, a second layer 220 is at least partially separable from the remaining portion 219 starting at a point on either side and proximate to the tab 212. The separation continues to move along both the first edge 225 and the second edge 227 as the tab is pulled. In yet other configurations, the tab can be located at an intermediate length along any edge.

By having a liner 300 with a lidding assembly 200, the contents within the liner 300 can be sufficiently secured and protected during transportation. Further, because the opening of the liner 300 can be resealed, the packaging system 100 can be used to store the contents even after the packaging system 100 has been opened. This saves the additional cost of storing the contents in separate containers. Once the liner is empty, the lidding assembly can be separated from the liner 300 such that each of the lidding assembly 200 and the liner 300 can be recycled separately.

Alternatively, the second layer 220 can be a strip of adhesive having a width less than that of the center portion 218 and with one side affixed to the center portion 218 and a second side extending from the sides of the center portion 218 and having the resealable adhesive. In the foregoing description, various embodiments of the present disclosure have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

In accordance with various embodiments, the second layer 220 may be formed from similar material as the first layer 210. In other embodiments, however, the second layer 220 may be formed without metallization. The second layer 220 may hold the first layer 210 closed with an adhesive applied to one side Like the first layer, the second layer may be formed from polypropylene, nylon, polyethylene, cast polypropylene and polyethylene terephthalate (PET). The second layer may be formed from a variety of thicknesses such as 30 ga to 90 ga. For example, the second layer 220 may be formed of about 50 ga PET.

In accordance with various embodiments, as illustrated in FIGS. 5A-C, the lidding assembly includes the seal 230 and a mechanism to keep the center opening defined by the outer portion 219 closed. While the mechanism is shown in the various Figures by way of example as a seal 240 to an additional layer 220, it is appreciated that in other embodiments, other mechanisms (e.g. zipping fastener, hook-and-loop closure, center portion with a self-adhering property, etc.) can be used to close the lidding assembly 200. Regardless of the mechanism, in various embodiments the release force of the closure mechanism (e.g. seal 240) is less than the release force of the seal. In this way, when the center portion is opened by releasing the closure mechanism, the force required to do so does not also cause any portion of the seal 230 to be destroyed. In one embodiment, the release force of seal 230 is greater than the release force of the closure mechanism (e.g. seal 240) but less than the release force that a person can exert on the mechanism by hand. In accordance with various embodiments, the perimeter seal 230 is 2-10 times stronger than the closure seal 240. In some embodiments, the release force of the seal 230 is less than a force required to tear through the entire first layer. In preferred embodiments, the release force of the destructible seal region 235 is greater than forces dictated under ISTA-3E shipping test in order to keep the packaging system 100 sealed under the test conditions. It is preferable that the destructible first seal causes the insignificant destruction of the lidding material from the self-supporting liner within only the destructible seal region. It is also preferable that the seal 230 is sufficiently strong that it can withstand a regular stressing due to the constant opening and closing of the closure mechanism. For example, the seal 230 remains intact while the seal 240 is unsealed and resealed a plurality of times.

Figure 4:
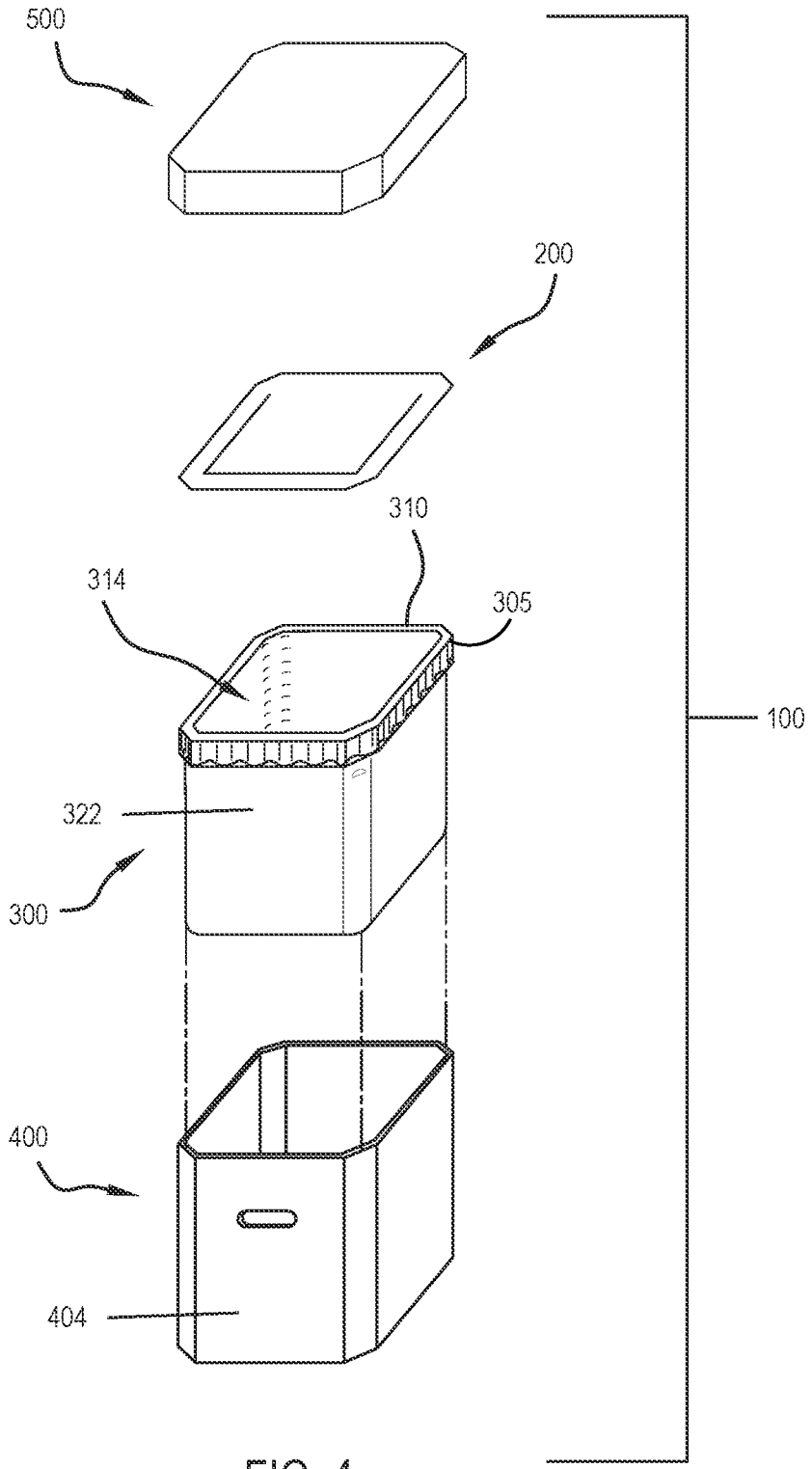
FIG. 4 is an exploded view of a packaging system of FIG. 1 in accordance with various embodiments as provided herein.

As illustrated in FIG. 4, carton 400 can receive the liner 300. The flange 310 and bottom wall of the liner 300 may support the liner 300 in the carton 400. A peel and reseal lidding assembly may be attached to the liner 300 on the flange 310. The carton lid 500 may cover the carton 400, enclosing the liner 300 and the lidding assembly 200 within.

In practice, the liner of the present disclosure may be filled with a liquid, viscous material, or particulate material before the liner is placed in the carton, or while the liner is in the carton. In existing conventional packaging systems, a liner might also be filled before being placed inside a box, or after being placed in a box. However, if a sealing member was going to be applied to the liner, the liner would have to be filled before being placed in the box. In that case, a sleeve or support member would need to be placed around the liner to stabilize the liner. Alternately, in conventional packaging systems, the liner could be placed inside the box and then filled with material, but in that case the liner could not be sealed with a lidding material. One such existing packaging system is described in U.S. Pat. No. 6,892,933, the entirety of which is hereby incorporated by reference herein. One novel and advantageous aspect of some embodiments of the present disclosure, however, is that the liner may be filled when it is in the carton and the lidding material may be sealed to the liner after the liner has been filled and while the liner is still in the carton.

In one embodiment, the liner 300 may be made of plastic and be relatively semi-rigid and thin, approximately in the range of about 8 mils to about 30 mils thick. The liner 300 is sufficient strong such that it can be self-supporting either empty of full. However, it is recognized that the liner thickness could vary and could be outside the range of about 8 mils to about 30 mils, and in some embodiments, may depend on the desired use or application of the liner 300. The liner 300 may be made by any means known in the art, such as, but not limited to, vacuum forming, blow molding, or injection molding. The liner 300 may be made, for example, of a 100% recyclable material, such as, but not limited to, high-density polyethylene (HDPE) or linear low-density polyethylene (LLDPE). Unlike the plastic film bags used in the bag & box assembly described above, the liner 300 may be self-supporting. However, the relative thinness of the liner may make the liner easily collapsible, which may significantly reduce the volume and cost of disposal as compared to traditional pails. Due to the thinness and/or the weight of the carton 400 and/or the liner 300, more, and in some cases significantly more, liners may be shipped via truck than traditional rigid buckets.

It will be appreciated that the liner 300 can include a variety of geometries. For example and without limitation, the opening of the liner 300 could be circular, or polygonal with more or less than four sides. In a preferred embodiment, the liner 300 has an overall rectangular shape but can also include chamfered corners as shown in FIGS. 1-4. The liner 300 may have a cross-sectional shape similar to the carton 400. In the illustrated embodiment, the liner 300 has a substantially square cross-sectional configuration and comprises a bottom wall 324 (see FIG. 3) and a side wall/panels 322 that can be substantially similar in shape to panels 404 of carton 400. When the plastic liner 300 is inside the carton 400, the plastic liner 300 may rest on and be supported by the bottom wall of the carton 400. Panels 322 may typically be generally slightly smaller than panels 404 of the carton so as to permit the liner 300 to fit inside the carton 400. In one embodiment, panels 322 of the liner 300 may lie substantially close to the side walls 404 of the carton 400 when the liner is placed in the carton. The top end of the liner 300 can be open, but may be formed with a rim 305. As can best be seen in FIG. 5B or 5C, the rim 305 of the liner 300 may include a radially extending flange portion 310 and a depending skirt portion 312. In various examples, at the termination of the side walls 322 distal from the bottom wall 324 is a rim 305. The rim 305 includes the flange 310 which extends outwardly (i.e. away from each of the side walls 322). The flange 310 includes the skirt 312 extending downwardly therefrom (i.e. toward a plane defined by the bottom wall but not toward the side walls). The rim 305 may extend fully around the perimeter of the liner 300, being an integral extension of the upper end of the panels 322. In another embodiment, the rim may extend partly around the perimeter of the liner. When the liner 300 is placed in the carton, the top edge of the carton sidewall 404 can be positioned underneath the rim 305 of the liner 300, with the top edge of the sidewall 404 between the sidewall of the liner 300 and the skirt portion 312. The side walls 322 define the open area or opening 314 with the rim 305 extending around the perimeter of the same. In accordance with various embodiments, the liner 300 includes a plurality of positioning features. The liner 300 is operable to be located inside of a carton 500. The carton includes walls 404 that define its perimeter. In some embodiments, the liner 300 may shift within the carton. The packaging assembly 100 can also be configured to be used safely and securely with a broad range of contents. As such, in various embodiments a snug fit between carton 400 and liner 300 may improve the utility of the packaging assembly 100. To that end, in various embodiments the package assembly 100 may include movement limiting elements. Movement limiting elements may include protrusions 340 that contact the carton 400. These protrusions include vertical ribs. The skirt 312 provides a pocket between the side wall 322 and the interior surface of the skirt 312 to receive wall 404 to aid in a more snug fit for the packaging assembly 100. The skirt may also include a plurality of ribs 340. The plurality of ribs 340 may extend from or into the surface of skirt 312. The plurality of ribs 340 extend from the flange portion 310 down to the end of the skirt 312. By forming these protrusions into or away from the skirt 312, the surface of the skirt 312 is strengthened. The ribs may also act as spacers to form a better fit around the wall 404. For example, ribs 340 may extend toward side wall 322 at a plurality of finite points. These finite points could interfere with the wall or merely close the gap toward the wall 404 when the liner 300 is installed in a carton 400 and the wall 404 extends into the cavity between the skirt 312 and the side wall 322. Because the points are spread and friction and pressure are minimized, even if they interfere they do not prevent the liner 300 from mating with the carton 400. In addition to these ribs, wall protrusions, specialized corners, or other features which limit movement between the carton and the liner can be utilized.

The skirt 312 may also include a flare 350 that extends away from the side wall. The flare 350 may also extend around the perimeter. The flare may be operable to help the skirt 312 receive the wall 404 when inserting the liner 300 into the carton 400. As the flare 350 extends away from the side wall 322, the flare 350 forms a wider entrance for receiving the wall 404 into the gap between skirt 312 and the side wall 322.

The liner and corresponding carton may include a variety of shapes, structures and configurations, examples of which are disclosed in Patent Pub. No. 2015/0083717 incorporated herein by reference in its entirety. The carton 400 may be a conventional cardboard box constructed of, for instance, corrugated cardboard and a stiff paperboard that may be 100% recyclable, although other light and/or recyclable materials may be used for the carton. The carton 400 may have a generally square or rectangular cross-sectional shape. Carton 400 may have a sidewall including four square or rectangular panels 404, a bottom wall, and in some embodiments, an open top without any flaps that need to be closed and/or sealed.

The packaging system 100 illustrated in FIG. 4 shows a lid 500 that may fit over both the liner 300 and the carton 400 when the liner is placed inside the carton. The lid 500 can be secured over the rim 305 of the liner 300. The lid 500 may be made of the same material as the carton 400 or the liner 300. In one example, the lid 500 is resilient plastic or other suitable resilient material and may be shaped to generally fit over the opening of the liner 300. The lid 500 may be attached to the liner 300 by pressing it down over the rim 305 of the liner 300. In another embodiment, the lid 500 may be made of, for instance, corrugated cardboard and a stiff paperboard that may be 100% recyclable. The lid 500 can have substantially the same shaped cross-section as the carton it will cover, except that the carton lid may be slightly bigger than the carton so that the carton lid may fit over, and in some cases securely over, the carton 400 and the liner 300. Thus, like the carton itself, the carton lid may be either square-shaped or rectangular-shaped. In some embodiments, the carton lid 500 may be generally integral with the carton 400 and at least partially separable from the carton along a corrugated tear strip, pull string, or perforation. Although not required, this type of carton lid may be preferably used with embodiments of liners that fit entirely within the sidewall panels 404 of the carton. The tear strip may be removed (or the pull string can be pulled, or the perforated line separated) so as to allow the carton lid 500 to at least partially separate from the carton 400. In some embodiments, the tear strip may extend entirely around the carton 400 so as to allow the carton lid 500 to be fully removed from the carton to expose the liner within. In other embodiments, the tear strip may extend only partially around, for example around three sides of the carton, so as to allow the carton lid 410 to be partially removed from the carton to expose the liner within, as shown in FIG. 4*c*. In either embodiment, the carton lid 410 may be reusable to reseal or re-cover the carton once access to the liner within is no longer desired. In further embodiments, the tear strip 412 may be located at any suitable position to allow a portion of the carton to open for access to the liner within.

In still another embodiment, the carton lid may be generally integral with the carton 400 and comprise one or more flaps which may be folded over the carton opening to close the carton. The flaps may also include one or more tear strips to secure the flaps in a closed position until the carton is opened for the first time.

Preferably, when the lidding assembly 200 is sealed to the liner 300, the packaging system 300 has sufficient strength and rigidity such that it passes the appropriate shipping tests under the International Safe Transit Association ("ISTA"). In particular, the packaging system 100 preferably has sufficient strength and rigidity to pass the ISTA-3E shipping test or an equivalent test that challenges the capability of the packaging system and contents therein to withstand transport hazards. In accordance with various embodiments, the lidding assembly 200 may be comprised of a stack of the second layer 220 being 48 ga PET with ink applied to nonstick areas (such as pull tab 212) and with an adhesive applied to one side, the first layer 210 being a 70 ga Metallized OPP with an adhesive. In some examples, a lidding material being a 4 Mil COEX nylon film is adhered to one side of the first layer 210 to act as a temper proof layer. This embodiment and similar embodiments may be used to package hot and cold materials. The assembly may have excellent hot tack and seal strength. The metallized structure gives the assembly improved oxygen and moisture barrier and good rigidity while maintaining some flexibility in order to keep the center portion 218 moveable for opening.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

Furthermore, in those instances where a convention analogous to "at least one of A, B, and C, etc." is used, in general such a construction is intended in the sense that one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense that one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Specific examples of operably couplable include but are not limited to physically mateable and/or physically interacting components.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

The invention claimed is:

1. A packaging assembly for holding contents, comprising:

a self-supporting liner having a rim;

a lidding assembly having an outer portion and a center portion that is movable with respect to the outer portion and configured to reseal an opening of the lidding assembly with the outer portion;

a resealable boundary between the center portion and the outer portion; and a seal which attaches the lidding assembly to the rim and is configured to permit separation of the lidding assembly from the rim such that rim is free of the lidding assembly after separation, wherein the seal is stronger than the resealable boundary.

2. The packaging assembly of claim 1, wherein the seal is configured to maintain a coupling between the rim and the outer portion during sealing and unsealing of the resealable boundary.

3. The packaging assembly of claim 1, wherein the separation of the lidding assembly from the rim is a clean separation defined by a delamination of the lidding assembly from the self-supporting liner.

4. The packaging assembly of claim 1, wherein, in response to the separation, the seal is destroyed while the self-supporting liner and the lidding assembly remain substantially intact.

5. The packaging assembly of claim 1, wherein the center portion is defined by at least one detached edge.

6. The packaging assembly of claim 5, wherein the center portion is associated with an adhesive portion overlapping the detached edge and defining the resealable boundary.

7. The packaging assembly of claim 1, wherein the outer portion surrounds the center portion.

8. The packaging assembly of claim 1, wherein the center portion is moveable with respect to the outer portion to open the opening through the lidding assembly while remaining at least partially attached to the outer portion at a hinge.

9. The packaging assembly of claim 1, wherein the seal has a sealing strength that is configured to withstand a force applied by contents of the self-supporting liner when the packaging assembly is inverted.

10. The packaging assembly of claim 1, wherein the seal is defined by a heat seal between the lidding assembly and self-supporting liner.

11. A packaging assembly for holding contents, comprising:

a self-supporting liner having a rim; and a lidding assembly having an outer portion coupled to the rim along a destructible seal region, the lidding assembly comprising a center portion that is moveable with respect to the outer portion and having an edge that defines a resealable boundary with the outer portion;

wherein the destructible seal region is configured to:

maintain a coupling between the rim and the outer portion during sealing and unsealing of the resealable boundary; and permit a clean separation of the lidding assembly from the self-supporting liner in response to a separation force that is greater than a resealable force used to unseal the resealable boundary.

12. The packaging assembly of claim 11, wherein the clean separation is defined by a delamination of the lidding assembly from the self-supporting liner.

13. The packaging assembly of claim 11, wherein:

the destructible seal region includes a seal having a first bond;

the edge includes a resealable adhesive having a second bond; and the first bond is stronger than the second bond.

14. The packaging assembly of claim 13, wherein the clean separation is defined by a destruction of the seal while the self-supporting liner and the lidding assembly remain substantially intact.

15. The packaging assembly of claim 11, wherein, in response to the clean separation, the rim is free of the lidding assembly.

16. The packaging assembly of claim 11, wherein the lidding assembly includes:

a first lidding material defining the center portion and the outer portion; and a second lidding material coupled with the first lidding material and defining the resealable boundary.

17. The packaging assembly of claim 16, wherein the second lidding material includes a peel-reseal seal configured to seal and unseal the lidding assembly a plurality of times.

18. The packaging assembly of claim 11, wherein:

the rim projects outwardly from a wall of the self-supporting liner; and the self-supporting liner further comprises a skirt portion extending downwardly from the rim.

19. The packaging assembly of claim 18, wherein the skirt portion cooperates with the rim to define a pocket configured to receive a wall of a carton.

20. The packaging assembly of claim 11, wherein the destructible seal region is defined about an entire perimeter of the self-supporting liner and the destructible seal region.

* * * * *